US005798608A

United States Patent [19]

Shaw

[11] Patent Number: 5,798,608

[45] Date of Patent: Aug. 25, 1998

[54] AVIONICS GRADE FLUORESCENT LAMP RESISTANT TO LUMEN DEPRECIATION

[75] Inventor: James E. Shaw, Cedar Rapids, Iowa

[73] Assignee: Rockwell International, Costa Mesa, Calif.

[21] Appl. No.: 526,128

[22] Filed: Sep. 7, 1995

[51] Int. Cl.[6] ..... H01J 61/35

[52] U.S. Cl. ..... 313/489; 313/485; 313/493; 313/486

[58] Field of Search ..... 313/485, 489, 313/493, 113, 114, 634, 635, 486

[56] References Cited

U.S. PATENT DOCUMENTS

| | | | |
|---|---|---|---|
| 3,141,990 | 7/1964 | Ray et al. | 313/221 |
| 4,119,889 | 10/1978 | Hollister | 313/485 X |
| 4,459,507 | 7/1984 | Flaherty | 313/485 X |
| 4,791,009 | 12/1988 | Arakawa et al. | 427/64 |
| 4,806,389 | 2/1989 | Peters et al. | 427/67 |
| 4,923,425 | 5/1990 | Ford | 445/58 |
| 4,946,707 | 8/1990 | Kasenge et al. | 427/64 |
| 4,952,422 | 8/1990 | Pappalardo et al. | 427/67 |
| 4,979,893 | 12/1990 | Pappalardo et al . | 427/67 |
| 5,126,166 | 6/1992 | Dutta et al. | 427/67 |
| 5,196,229 | 3/1993 | Chau | 427/67 |
| 5,200,233 | 4/1993 | Mohacsi | 427/67 |
| 5,220,249 | 6/1993 | Tsukada | 313/493 X |
| 5,387,837 | 2/1995 | Roelevink et al. | 313/493 X |
| 5,464,566 | 11/1995 | Ito et al. | 252/582 |
| 5,520,855 | 5/1996 | Ito et al. | 313/479 X |
| 5,531,928 | 7/1996 | Karam et al. | 252/301.4 F |

FOREIGN PATENT DOCUMENTS

| | | |
|---|---|---|
| 44-12273 | of 0000 | Japan . |
| 44-12274 | of 0000 | Japan . |
| 54-124582 | of 0000 | Japan . |
| 55-056335 | of 0000 | Japan . |
| 55-53055 | of 0000 | Japan . |

*Primary Examiner*—Ashok Patel
*Attorney, Agent, or Firm*—Kyle Eppele; L. Keith Stephens; James P. O'Shaughnessy

[57] ABSTRACT

A fluorescent lamp is provided which is resistant to lumen depreciation. The fluorescent lamp includes a tube constructed of an ultraviolet (UV) radiation transmissive material. A gas inside of the tube produces UV radiation in response to a stimulus. Phosphor particles in a phosphor particle containing coating adhered to an outer surface of the tube absorb UV radiation produced by the gas inside of the tube and producing visible light in response.

13 Claims, 7 Drawing Sheets

AVIONICS GRADE FLUORESCENT LAMP RESISTANT TO LUMEN DEPRECIATION

CROSS-REFERENCE TO RELATED APPLICATIONS

The following U.S. Patents and co-pending U.S. Patent Applications are herein incorporated by reference: U.S. Pat. No. 5,196,229 entitled "Coated Phosphor Articles" and assigned to GTE Products Corporation; co-pending and commonly assigned U.S. patent application Ser. No. 8/525,429 of Chung et al. entitled "Use of Sol-Gel Materials as Phosphor Carriers in Fabrication of Fluorescent Lamps" filed on even date herewith now allowed; and co-pending and commonly assigned U.S. patent application Ser. No. 08/524,978 of Chung entitled "Method of Preparing Organically Modified Aluminosilicates Films" filed on even date herewith now allowed.

BACKGROUND OF THE INVENTION

The present invention relates generally to liquid crystal displays (LCDs), and more particularly to an improved fluorescent lamp which is resistant to lumen depreciation.

Fluorescent lamps are generally constructed from soda lime or other glass, with a phosphor coating on the inside of the glass. Inside the lamp is a low pressure gas, for example an argon (Ar) and mercury (Hg) mixture, which can be excited to generate ultra-violet (UV) energy. The UV energy strikes the phosphor, causing the lamp to produce visible light. However, these fluorescent lamps introduce a number of undesirable problems.

Fluorescent lamps currently used in avionics and other LCD backlighting applications suffer from a time and/or current density dependent phenomenon known in the art as lumen depreciation. Lumen depreciation is caused by the Hg ion bombardment of the phosphor crystalline structure or lattice. As Hg ions collide with the phosphor coating, the upper layers of the lattice are disrupted, reducing the phosphor coating's ability to produce visible light. The resulting layer of "dead" phosphor absorbs some of the UV energy without producing visible light, thus reducing the efficacy of the lamp. As a consequence, the lamp suffers from a significant luminance reduction, or a power consumption increase to compensate for the luminance fall off, as the number of operational hours of the lamp increases.

Another example of a problem exhibited by existing fluorescent lamps, which is particularly important in avionics type applications, is that most existing processes of coating the inside diameter of the lamp with phosphor result in a coating having non-uniform thickness. The variation in the thickness of the phosphor coating causes a variation of efficacy of the lamp, and thus, results in an increase in power consumption and a decrease in lamp life.

Additionally, bending a pre-coated phosphor lamp tends to stretch the phosphor, creating voids in phosphor coverage and generally damaged areas of phosphor. The bend areas of an avionics grade lamp are typically one-half as bright as the straight sections. These areas tend to degrade faster than the straight sections, further enhancing a condition of luminance non-uniformity for the LCD.

SUMMARY OF THE INVENTION

It is an object of the present invention to provide a fluorescent lamp resistant to lumen depreciation. It is a second object of the present invention to provide a fluorescent lamp having increased luminance output. It is a third object of the present invention to provide a fluorescent lamp having increased phosphor surface area as compared to conventional lamps of the same shape and size. The present invention achieves these objects and others discussed throughout this application.

According to the present invention, a fluorescent lamp is provided which is resistant to lumen depreciation. The fluorescent lamp includes a tube constructed of an ultraviolet (UV) radiation transmissive material. A gas inside of the tube produces UV radiation in response to a stimulus. Phosphor particles in a phosphor particle containing coating adhered to an outer surface of the tube absorb the UV radiation produced by the gas inside of the tube and produce visible light in response.

BRIEF DESCRIPTION OF THE DRAWINGS

The invention may be more fully understood by reading the following description of preferred embodiments of the invention in conjunction with the appended drawings wherein.

DETAILED DESCRIPTION OF THE PREFERRED EMBODIMENTS

The present invention is based in part upon the recognition that a tubular construction fluorescent lamp having its phosphor coating on the outside of the lamp glass provides a mechanism for eliminating or reducing lumen depreciation by isolating the Hg ions from the phosphor. At the same time, phosphor uniformity is improved and overall phosphor surface area is increased. The present invention provides these benefits, in a lamp which can be used as a drop in replacement for conventional lamps, without introducing UV radiation and ozone generation problems caused by many alternative methods of addressing the lumen depreciation phenomenon.

Figure 1:
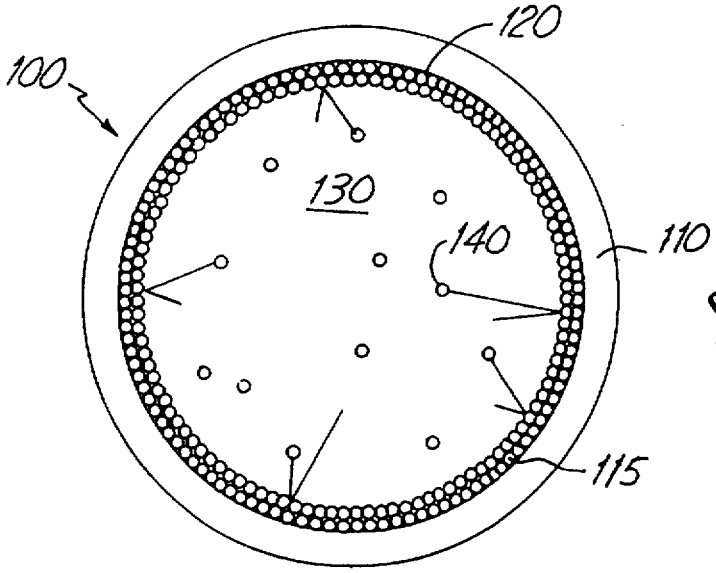
Fig. 1 PRIOR ART
FIG. 1 is a diagrammatic end view of a section of a prior art fluorescent lamp.

FIG. 1 is a diagrammatic end view of a section of a prior art fluorescent lamp which is representative of existing fluorescent lamp designs. Fluorescent lamp 100 includes tube or lamp glass 110, phosphor coating 120, and Ar/Hg gas mixture 130. Glass 110 is typically of a soda-lime glass construction having a leaded glass additive to soften it for shape manipulation. Phosphor coating 120 is adhered to inner surface 115 of glass 110 by any conventional means, such as by bonding the phosphor particles to the glass with a binder.

Inside of glass 110 is contained a low pressure Ar/Hg gas mixture 130 (in other embodiments, other noble gases such as Ne and Xe are used). A filament (not shown in FIG. 1) injects electrons into the plasma as a potential is applied across lamp 100. The electrons excite the Hg atoms, causing the generation of UV energy which strikes phosphor coating 120. In response, phosphor coating 120 emits visible light through glass 110 for use in the avionics application.

Figure 2:
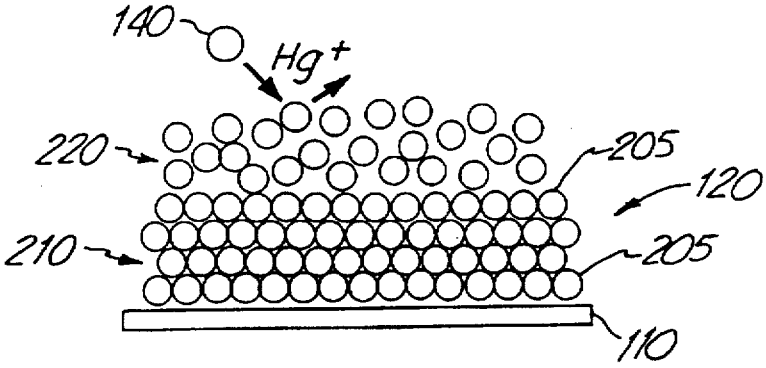
Fig. 2 PRIOR ART
FIG. 2 is a diagrammatic illustration of the lumen depreciation process caused by Hg ion bombardment of the phosphor lattice in the prior art fluorescent lamp illustrated in FIG. 1.

FIG. 2 is a diagrammatic illustration of the lumen depreciation mechanism or process caused by Hg ion bombardment of the phosphor lattice of layer 120 in prior art fluorescent lamp 100 illustrated in FIG. 1. The efficacy of the phosphor in producing visible light depends upon layer 120 having a structured lattice of phosphor particles 205. When Hg ions 140 strike phosphor lattice 210, upper layers 220 of the lattice are disrupted, reducing the ability of layer 120 to produce visible light. Layer 220 of "dead" phosphor absorbs some of the UV energy without producing visible light, thus reducing the efficiency of the lamp.

Figure 3:
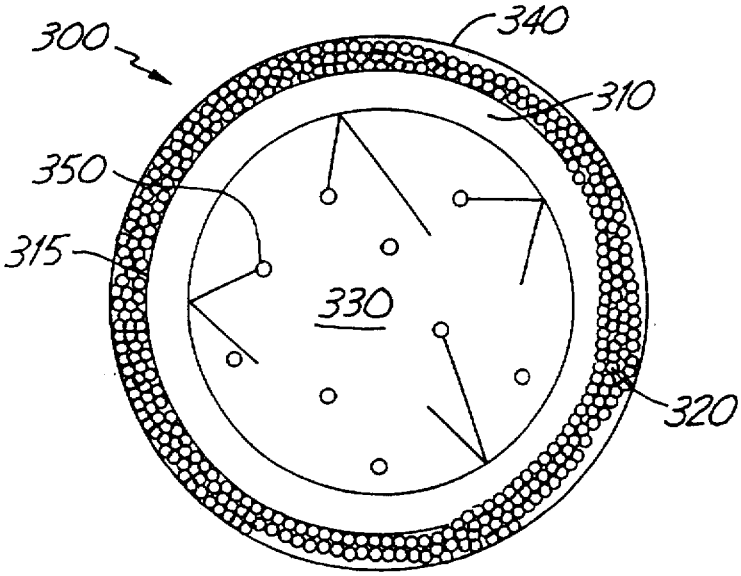
FIG. 3 is a diagrammatic end view of a section of a fluorescent lamp according to preferred embodiments of the present invention.

FIG. 3 is a diagrammatic end view of a section of a fluorescent lamp according to preferred embodiments of the present invention. Several preferred methods of constructing fluorescent lamp 300 of the present invention are discussed below with reference to FIGS. 4A–4C and 5A–5B. Fluorescent lamp 300 includes tube or lamp glass 310, phosphor containing layer 320, Ar/Hg gas mixture 330 and protective coating 340.

In preferred embodiments, glass 310 is constructed of a UV transmissive material such as quartz. Preferably, glass 310 is a material highly transmissive to UV radiation, and particularly, to 253.7 nanometer radiation. The transmittance of the glass envelope is preferably greater than 90% at this wavelength. Also, glass 310 is preferably a material resistant to browning or color center formation effects, caused by the imbedding of Hg molecules in the glass, which occur in conventional soda lime glass lamps. Therefore, glass 310 should not contain dopants or impurities which will brown or degrade transmittance over time. Quartz fluorescent tubes are known in the art and are frequently used in germicidal and tanning bed lamp applications. Like conventional fluorescent lamps, lamp 300 has Ar/Hg gas mixture 330 (or an appropriate substitute gas) contained inside for producing UV energy in response to excitation of the gas molecules. In general, lamp 300 can be constructed to be the same size and shape (typically serpentine) as existing fluorescent lamps such that lamp 300 can act as a drop-in replacement for these existing fluorescent lamps in their current applications.

Phosphor particles 320 are adhered to outer surface 315 of glass 310 by any suitable manner of uniform and/or controllable deposition such as a spray or a dip coat process. For instance, in some embodiments, phosphor particles 320 are formed in a coating similar to phosphor coating 120 of lamp 100 illustrated in FIG. 1. In these embodiments, phosphor particles 320 can be adhered to outer surface 315 with a lacquer binder in a conventional manner similar to the manner in which coating 120 is adhered to inner surface 115 of glass 110. Also, the deposition of phosphor particles 320 on outer surface 315 can be controlled in order to tailor the light output distribution of the lamp as a function of the thickness of the applied phosphor. By creating an optimum phosphor layer in certain portions of the lamp, light output intensities from these portions can be increased. Controlling phosphor deposition thicknesses on the outside of lamp 300 of the present invention is much less difficult than controlling deposition thicknesses on the inside of conventional lamp designs. Several preferred methods of adhering phosphor particles 320 to outer surface 315 are discussed in greater detail with reference to FIGS. 4A–4C and 5A–5B.

Phosphor particles 320 are protected by coating material 340 to prevent humidity intrusion, mechanical damage caused by handling or physically moving the lamp, and/or contamination from damaging the phosphor. Coating 340 is preferably a rugged and optically transparent material in order to maximize the visible light output of lamp 300. In preferred embodiments, protective coating 340 is an index matching coating so that losses of visible light energy due to reflection are minimized. As is discussed below with reference to FIGS. 4A–4C and 5A–5B, protective coating 340 can be any number of different types of coating such as a polymer or a sol-gel coating. Further, any number of different methods of applying protective coating 340 to phosphor particles 320 can be used.

Lamp 300 of the present invention eliminates or minimizes lumen depreciation by isolating Hg ions 350 from phosphor particles 320. In other respects, lamp 300 functions similarly to conventional lamps. As is the case with conventional lamps, filaments (not shown) are used to inject electrons into the Ar/Hg gas mixture as a voltage potential is applied across lamp 300. The electrons excite the Hg atoms, causing the generation of UV energy which passes through the UV transmissive material of tube or glass 310 such that it is absorbed by phosphor particles 320. In response, phosphor particles 320 emit visible light. However, Hg ions, which cannot penetrate glass 310, are prevented from bombarding the phosphor lattice. Thus, this source of lumen depreciation is eliminated or minimized.

Lamp 300 provides increased efficacy over prior art fluorescent lamps in several other ways as well. First, as discussed above, placing the phosphor on the outside of the tube or glass of the lamp allows increased control over phosphor thickness uniformity. When desired, sections of the lamp can be coated with an optimum layer of phosphor particles to tailor the luminance for a particular application. Second, by placing the phosphor on the exterior surface of the glass of lamp 300, the phosphor surface area is increased. This increase in phosphor surface area, typically on the order of 10 percent for smaller, thick walled lamps, provides a measurable increase in luminance output without increasing the space occupied by the fluorescent lamp. Further, this allows the optimal glass thickness to be selected for a particular application or tube forming operation without sacrificing phosphor surface area. Also, no stretching or cracking of the phosphor occurs since it is applied after the glass tube is bent into its desired shape. This common problem in many prior art fluorescent lamp designs, which necessitate that the phosphor be applied before bending, is thus prevented.

Yet another specific advantage of the approach of the present invention is the elimination of UV and ozone generating mechanisms on aircraft flight decks. Other designs using flat phosphor plates and germicidal lamps in reflecting cavities require inert gas filled or vacuum enclosures between the phosphor and the lamp to prevent the UV radiation from creating ozone or radiation leakage from entering the flight deck. These alternate designs are typically heavy and expensive to produce. The present invention does not suffer from these drawbacks. In sum, the above advantages and others result in lamp 300 being well suited as a drop in replacement for prior art lamps, while providing advantages such as increased luminance efficacy, the potential for higher yields, and a constant source of light energy without the problem of lumen depreciation.

Figure 4A:
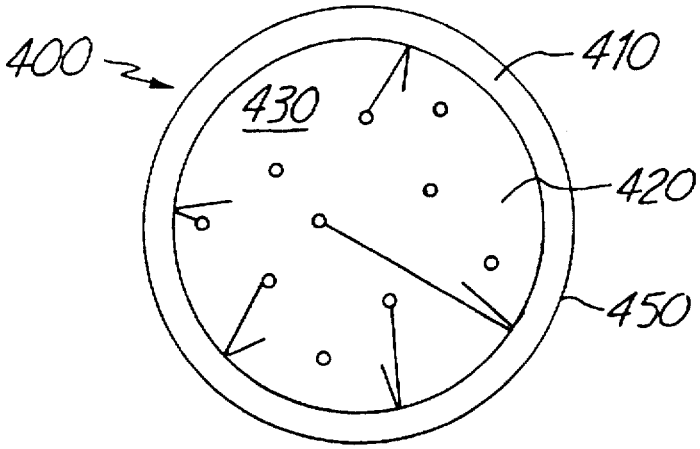
FIGS. 4A through 4C are diagrammatic end views of a fluorescent lamp in various stages of fabrication corresponding to a first preferred method of the present invention.
Figure 4B:
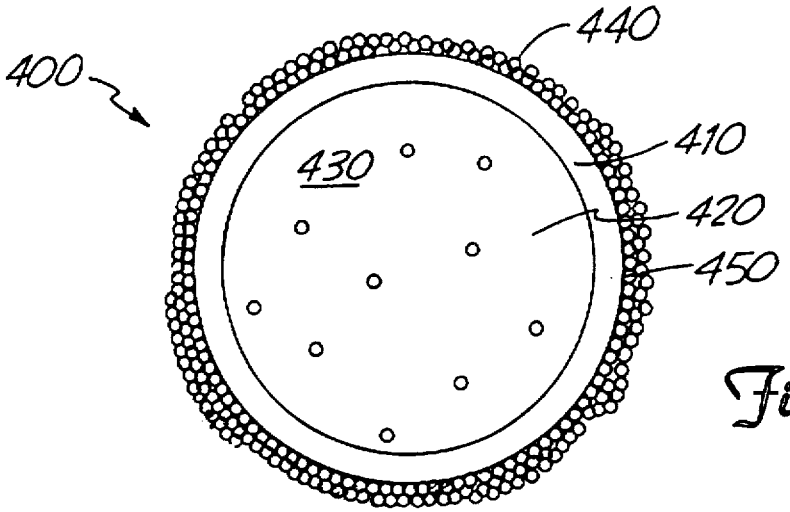
Figure 4C:
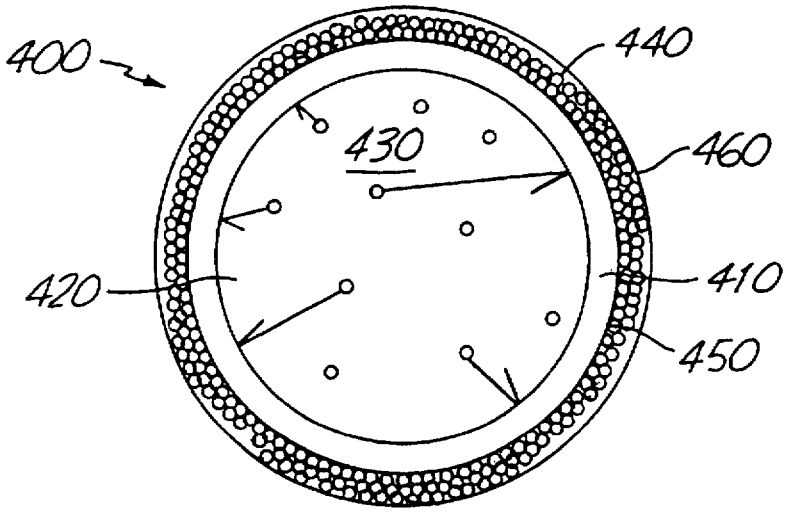

FIGS. 4A through 4C are diagrammatic end views illustrating first preferred methods of fabricating the improved fluorescent lamps of the present invention. First, a straight quartz tube 410 is bent, using conventional quartz bending techniques, into the desired serpentine or other shape. A tube made from a suitable material other than quartz can be used instead. Next, gases are evacuated from inside area 420 of tube 410. Ar/Hg gas mixture 430 is placed inside of tube 410, and filaments (not shown) are press sealed (or other suitable method) into the ends of the lamp. Normal lamp processing steps are used to prepare the lamp for the phosphor application. The result of these steps are depicted in FIG. 4A.

At this point, a potential is applied to the filaments and across each end of the lamp 400, to verify that it is thus far functioning properly. Appropriate precautions must be made during verification to protect nearby persons from the UV radiation produced by the Ar/Hg gas inside of tube 410. Assuming that lamp 400 is thus far functioning properly, phosphor particles 440 are next adhered to outer surface 450 of tube 410. This is depicted in FIG. 4B.

Adhering phosphor particles 440 to outer surface 450 can be accomplished in a number of different manners. For instance, surface 450 can be treated with a coating that sticks well to the quartz or other glass material. Phosphor particles can then be adhered to the coating. In the alternative, surface 450 can be physically altered by processes such as chemical etching, liquid honing and/or sand blasting to create a surface to which phosphor particles 440 will better adhere. In general, as strong of an adhesion as is possible without unduly interfering with the performance of the lamp is desired. Yet another technique for adhering the phosphor particles to the outer surface of the tube is discussed below with reference to FIGS. 5A and 5B.

After treating outside surface 450, if such a treatment was necessary to facilitate adhesion to the particular tube material chosen, phosphor particles 440 are applied to the surface 450, or to any previously applied coating added to facilitate adhesion. Phosphor particles 440 can be applied by any suitable method. One contemplated manner in which phosphor particles are applied to outer surface 450 of the lamp glass is by hand spraying a layer of lacquer\phosphor mixture similar to lacquer\phosphor mixtures used in conventional fluorescent lamps. In the alternative, an automated or robotic system can be readily adapted for coating outer surface 450 with the lacquer\phosphor mixture. Such an automated system is particularly preferable for facilitating the variable control of thickness of the phosphor layer.

Next, in embodiments using lacquer or other lacquer materials, lamp 400 is heated to bake off some of the lacquer material. Finally, to protect the layer or lattice of phosphor particles, protective coating 460 is added by any suitable means. The results of this step are illustrated in FIG. 4C. Spraying lamp 400 with protective coating material and dipping lamp 400 into protective coating material are two contemplated preferred methods of applying coating 460. However, other means of coating lamp 400, such as brushing on the protective coating material, can be used as well. Protective coating 460 is, in preferred embodiments an index matching coating so that losses of visible light energy due to interface reflections are minimized. For example, protective coating 460 can be a polymer or a sol-gel coating. Aluminosilicates sol-gel film coatings of the types described in co-pending and commonly assigned U.S. patent application Docket No. 08/524,978 are contemplated to be preferred coating materials because of the effectiveness of sol-gel materials at increasing luminance output and at decreasing luminance depreciation. This preferred sol-gel process is described in detail with reference to FIG. 10.

Figure 5A:
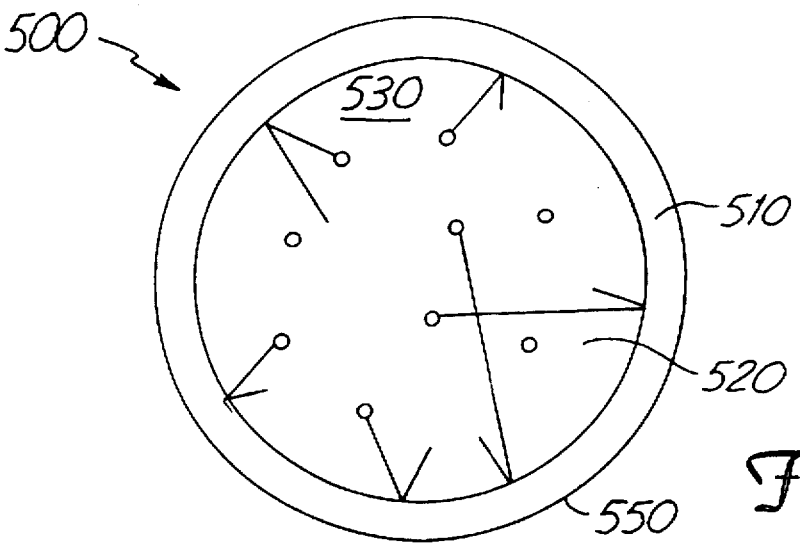
FIGS. 5A and 5B are diagrammatic end views of a fluorescent lamp in various stages of fabrication corresponding to a second preferred method of the present invention.
Figure 5B:
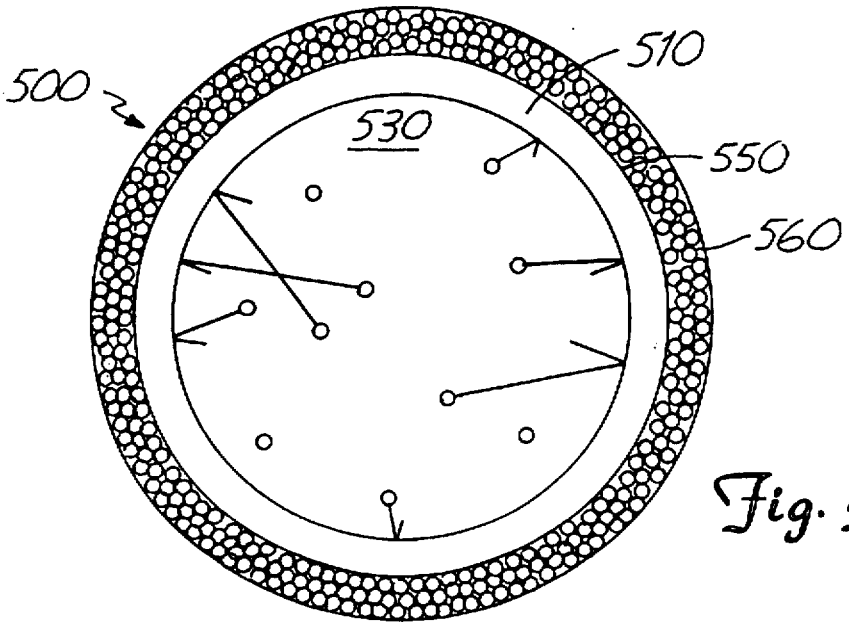

FIGS. 5A and 5B are diagrammatic end views illustrating second preferred methods of fabricating the improved fluorescent lamps of the present invention. The initial steps of these second preferred methods, the result of which is depicted in FIG. 5A, are the same or similar to those of the methods discussed with reference to FIGS. 4A–4C. In review, quartz tube 510 is bent into the desired shape. Gases are evacuated from inside area 520 and Ar/Hg gas mixture 530 is placed inside of tube 510. Filaments (not shown) are press or butt sealed into the ends of the lamp, and electrical power is applied to the filaments and a potential across the lamp to test operation of the lamp for proper UV generation before continuing further.

The second preferred methods of fabricating the improved fluorescent lamps of the present invention differ from the preferred methods described with reference to FIGS. 4A–4C in the manner of application of the phosphor and the protective coating to outer edge 550 of tube 510. According to the second preferred methods, the step of applying a coating of phosphor particles and the step of applying a protective sol-gel coating are combined. Phosphor particles are pre-mixed with the sol-gel. The phosphor\sol-gel mixture is then sprayed or dip-coated onto outer surface 550 to form phosphor\sol-gel layer 560. This is depicted in FIG. 5B. In addition to the previously described protection and luminance enhancing benefits provided by the sol-gel, applying the sol-gel and phosphor as a combined mixture increases the adhesion between the phosphor particles and outer surface 550 of the lamp glass. This is particularly beneficial considering the problems experienced by conventional fluorescent lamps at maintaining the adhesion between the phosphor and the lamp glass.

Figure 6:
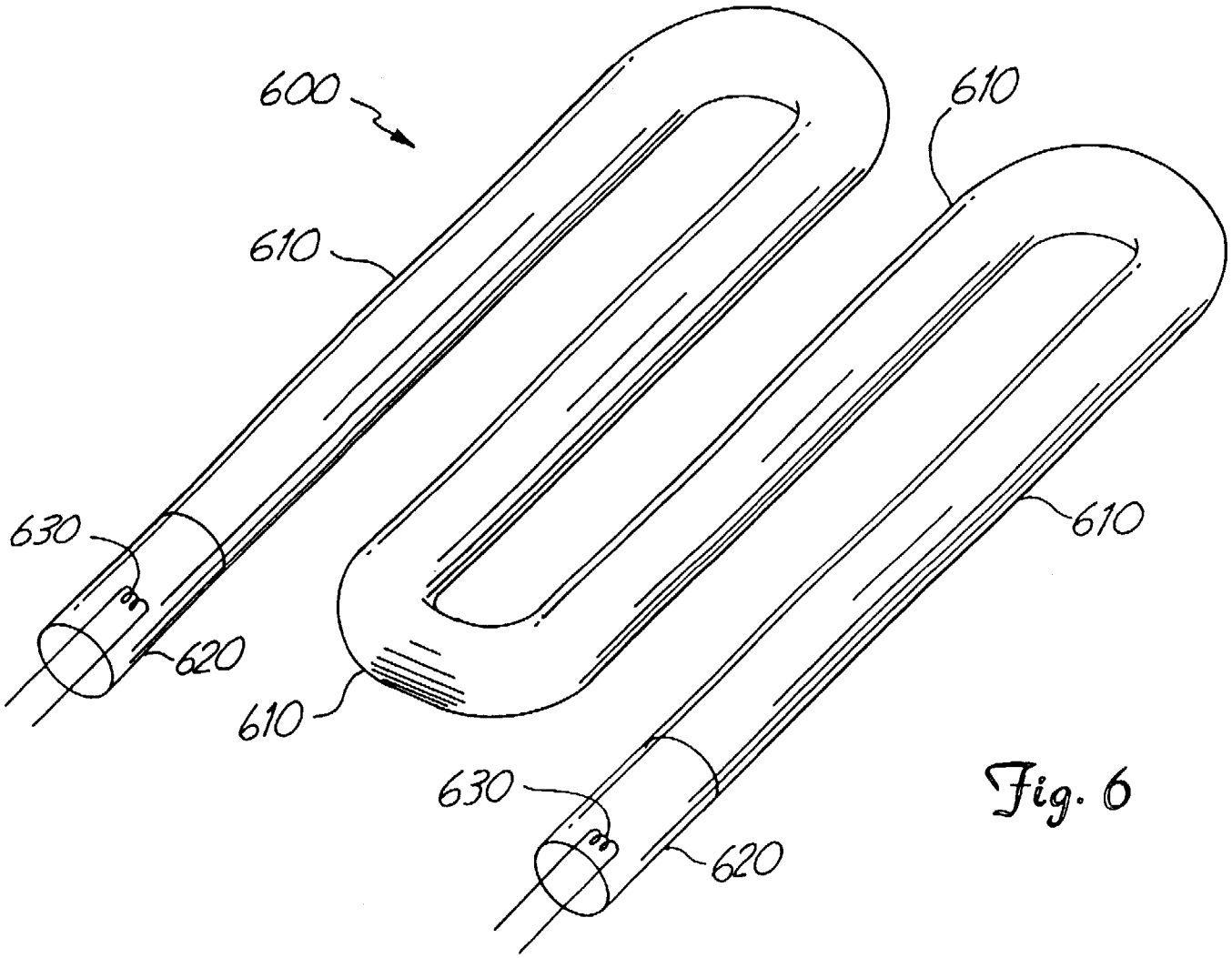
FIG. 6 is a diagrammatic perspective view of a fluorescent lamp which illustrates additional features of the present invention.

It is important when testing and when performing a failure analysis of fluorescent lamps that the filaments be visible for observation. FIG. 6 illustrates a feature of fluorescent lamp 600 of the present invention which facilitates the safe observation of the lamp's filaments. Lamp 600 has portions 610 which are coated on the outside with phosphor as described above. However, end portions 620 are not coated with phosphor so that filaments 630 can be visibly observed. To protect individuals in the vicinity of lamp 600 from UV radiation during operation of the lamp, a UV absorbing transparent material is used to coat end portions 620 of lamp 600 since no phosphor is present to absorb UV radiation. After coating or otherwise treating portions 620 of lamp 600, the glass in this filament area is preferably passive to visible light, but absorbs a large percentage of the UV energy. The UV absorbing material can be a treated polycarbonate. Alternatively, a sleeve of UV absorbing glass can be used to cover end portions 620.

Figure 7:
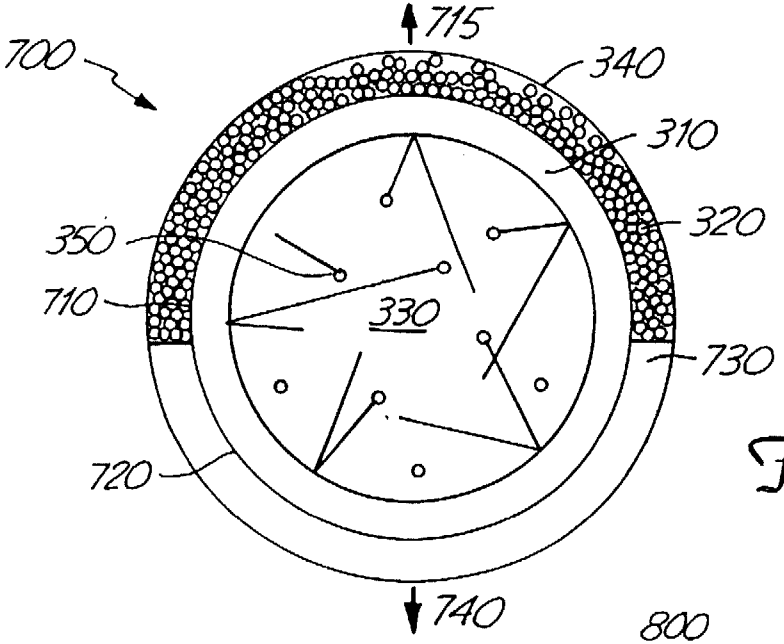
FIG. 7 is a diagrammatic end view of a section of a fluorescent lamp according to alternate embodiments of the present invention.

FIG. 7 is a diagrammatic end view of a section of a fluorescent lamp in accordance with alternate embodiments of the present invention. Lamp 700 is similar to lamp 300 illustrated in FIG. 3 in that it includes tube or lamp glass 310, phosphor containing layer 320, Ar/Hg gas mixture 330 and protective coating 340. Lamp 700 differs from lamp 300 in that phosphor containing layer 320 and protective coating 340 are positioned only on portion 710 of the outer surface of lamp glass 310. Portion 710 of the outer surface of lamp 700 will typically face generally in direction 715 toward the liquid crystal display (not shown), and may occupy more or less of the circumference of the tubular lamp glass than is shown in FIG. 7. Portion 720 of the outer surface of lamp 700 is coated with UV reflective material 730. Portion 720 of the outer surface of lamp glass 310 will typically face generally in direction 740 away from the liquid crystal, and may occupy more or less of the circumference of the tubular lamp glass than is shown in FIG. 7. Portions 710 and 720 of the outer surface of lamp glass 310 preferably constitute the entire outer surface of lamp glass 310. Aluminum is the contemplated preferred UV reflective material.

The benefit of lamp 700 over lamp 300 is that UV radiation generated generally in direction 740 will be reflected by UV reflective material 730 back generally toward direction 715 after passing through UV transmissive glass 310. Then, the UV radiation reflected by UV reflective material 730 is transmitted through glass 310 once again for use in stimulating the phosphor particles in phosphor containing layer 320. Thus, the UV radiation available for stimulating the phosphor particles adjacent to portion 710 of glass 310 can be greatly increased. The result is that the phosphor particles in phosphor containing layer 320 adjacent to portion 710 of the lamp glass will produce more visible light projected into the desired direction. This allows the reflector assemblies typically needed in backlighting systems to redirect energy generated in direction 740 to be eliminated.

Figure 8:
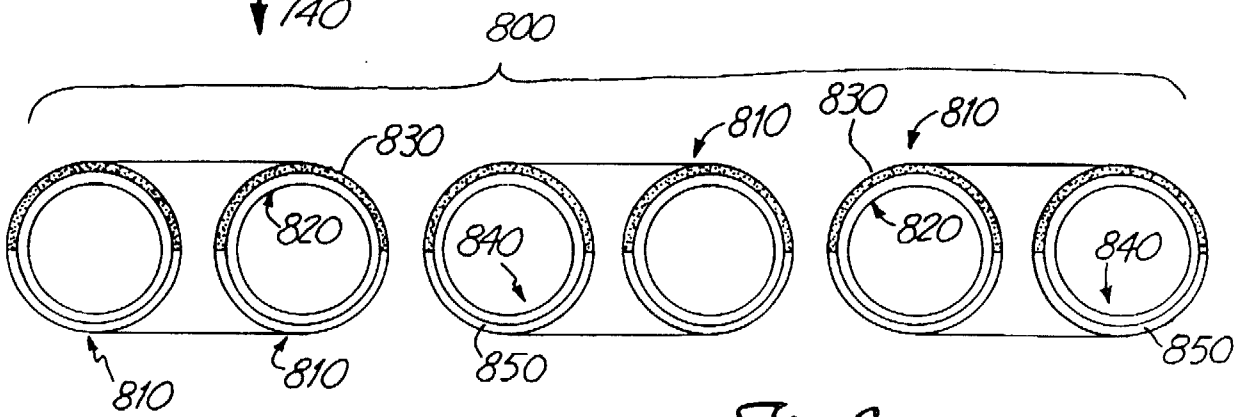
FIG. 8 is a diagrammatic end view of the fluorescent lamp of FIG. 7 having the phosphor coating on a first outside surface of the lamp legs and having an UV reflective coating on a second outside surface of the lamp legs.

FIG. 8 is a diagrammatic cross-sectional end view of a serpentine multiple leg lamp constructed in accordance with fluorescent lamp 700 of FIG. 7. As with lamp 700, sections 810 of lamp 800 have phosphor coating 830 on "front" portions of the outside surface of the lamp glass and have UV reflective coating 850 on "rearward" facing portions of the outside surface of the lamp glass. FIG. 8 is included to illustrate that sections or legs 810 of lamp 800 must be positioned close together, as compared to traditional serpentine lamps, in order to eliminate the reflector assembly.

Figure 9:
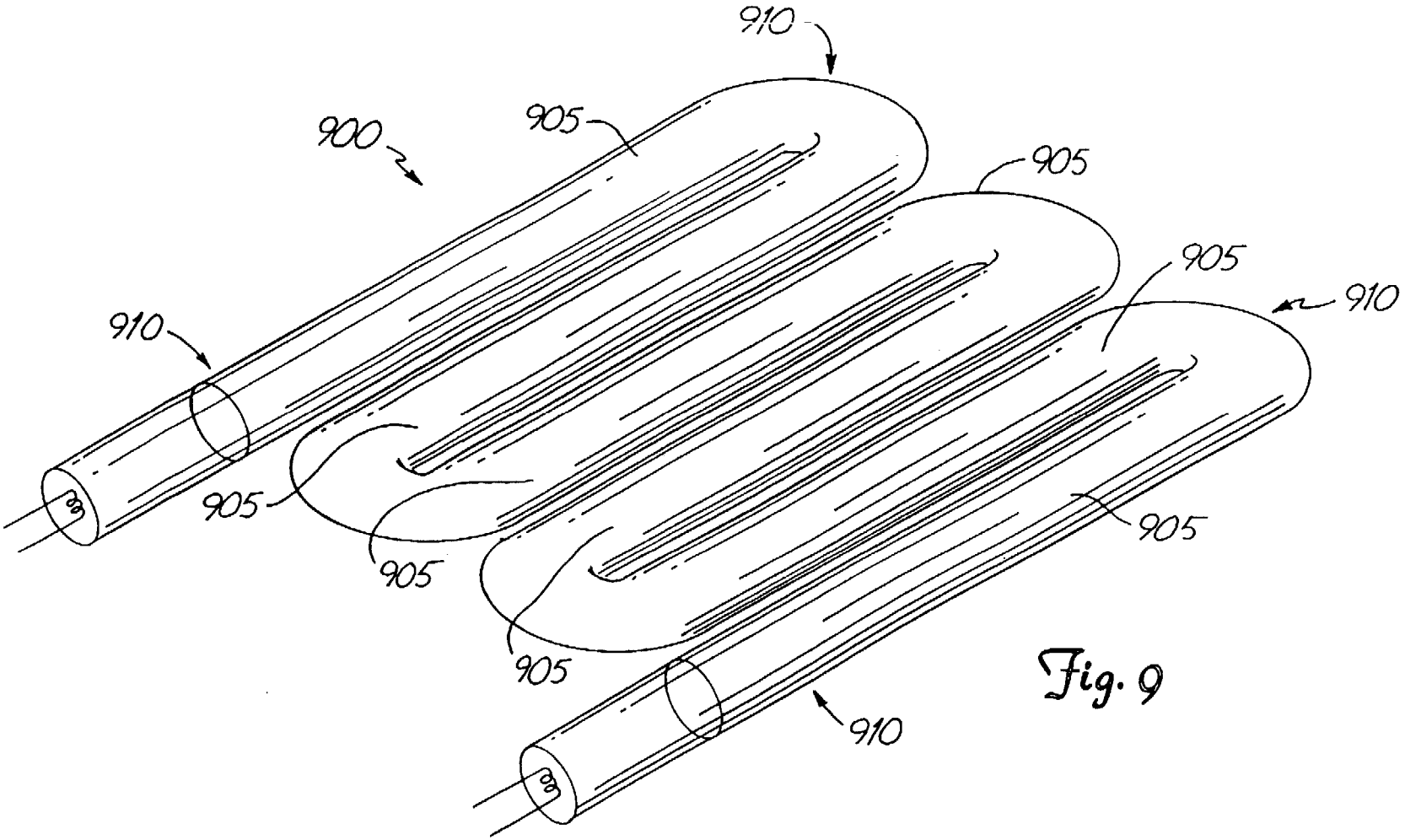
FIG. 9 is a diagrammatic perspective view of a fluorescent lamp in accordance with the alternate embodiments of the present invention illustrated in FIGS. 7 and 8, but in which only chosen outside surfaces in the corner areas of the lamp have the UV reflective coating.

FIG. 9 is a diagrammatic perspective view of a fluorescent lamp in accordance with the alternate embodiments of the present invention illustrated in FIGS. 7 and 8, but in which only selected outside surfaces in corner areas of the lamp have the UV reflective coating. Otherwise, lamp 900 is constructed similarly to lamp 600 illustrated in FIG. 6. Sections 905 of lamp 900 have a phosphor coating around the entire outer surface of the lamp glass in accordance with earlier discussed embodiments of the present invention. However, selected corners 910 of lamp 900 have the reflective coating configuration illustrated in FIG. 7. This allows lamp 900 to be used with a reflector assembly (not shown) in a conventional manner, while simultaneously eliminating or reducing a known problem in the art. Traditionally dim corners of an LCD, when backlit by lamp 900, can be brightened by increasing the directionality of the luminance output in corresponding corner areas 910 with the UV reflective coating configuration discussed previously.

Figure 10:
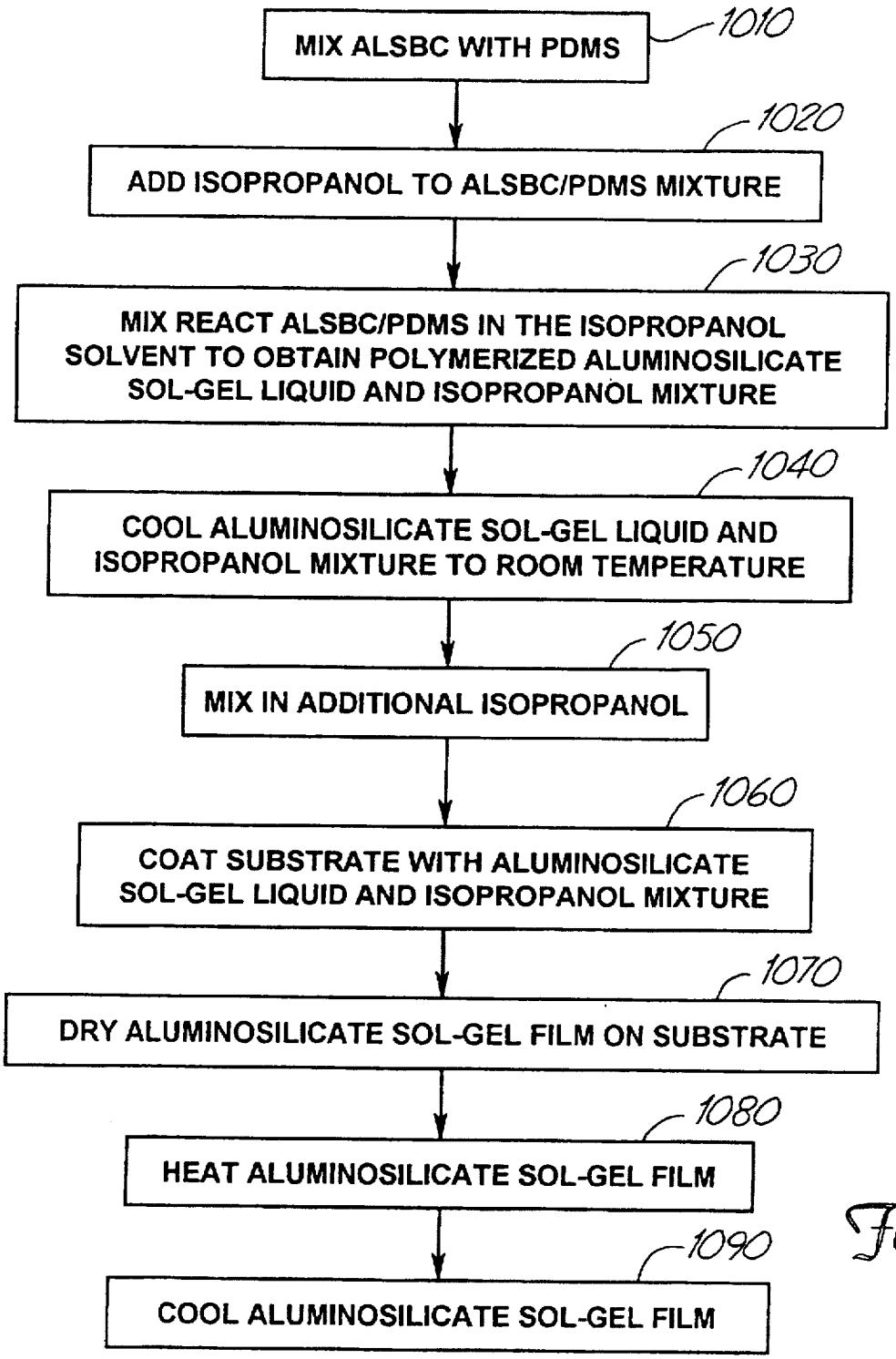
FIG. 10 is a flow diagram illustrating a preferred process for producing aluminosilicates sol-gel film protective coatings.

FIG. 10 is a flow diagram illustrating a preferred method of producing aluminosilicate sol-gel films. The preferred method illustrated in FIG. 10 provides a process for producing aluminosilicates and/or aluminosilicates oxide sol-gel films having minimal cracking. Thus, the process can be used to create protective coating 460 discussed above specifically with reference to FIG. 4C. Similarly, the process illustrated in FIG. 10 can be altered slightly by combining the phosphor particles and the sol-gel solution to form phosphor\sol-gel layer 560 as discussed with reference to FIG. 5B. The process illustrated in FIG. 10 is discussed in more detail in co-pending and commonly assigned patent application Docket No. 08/524,978 of Chung entitled "Method of Preparing Organically Modified Aluminosilicates Films." The steps of the sol-gel process of FIG. 10 are as follows:

Step 1010: Mix or combine an aluminum alkoxide with a silicone oligomer. The aluminum alkoxide is preferably aluminum di (sec-butoxide) acetoacetic ester chelate ($Al(OC_4H_9)_2(C_6H_9O_3)$). The silicone oligomer is preferably silanol terminated polydimethylsiloxane ($(SiO(CH_3)_{22}(OH)_2$). The aluminum di (sec-butoxide) acetoacetic ester chelate (hereinafter ALSBC) and the silanol terminated polydimethylsiloxane (hereinafter PDMS) are combined in a 1 to 1 weight ratio. Alternatively stated, ALSBC and PDMS are combined or mixed in a 5.8 to 1 mole ratio.

Step 1020: Add organic solvent to the ALSBC\PDMS mixture. In preferred embodiments, the organic solvent is isopropanol and is mixed in a volume ratio of 1 part isopropanol to 2 parts ALSBC\PDMS mixture. Steps 1010 and 1020 can be combined into a single step if desired. The ALSBC\PDMS and isopropanol are preferably combined at room temperature.

Step 1030: Mix\react the ALSBC\PDMS in the isopropanol solvent to facilitate the sol-gel reaction and reflux at approximately the boiling temperature of the isopropanol. In preferred embodiments, the ALSBC\PDMS and isopropanol are mixed at approximately 80° C. (±3° C.) for about 30 minutes. The result of step 1030 is a mixture of isopropanol solvent and at least partially polymerized aluminosilicate sol-gel.

Step 1040: Cool the aluminosilicate sol-gel and isopropanol mixture to room temperature. The rate of cooling is not particularly important and can vary widely to accommodate a manufacturing setting. The result of step 1040 is a viscous liquid containing isopropanol and partially polymerized aluminosilicate sol-gel.

Step 1050: Mix in additional isopropanol solvent to the viscous isopropanol and aluminosilicate sol-gel mixture to reduce the viscosity of the mixture. In preferred embodiments, the additional isopropanol is added in a volume ratio of approximately 4 parts isopropanol to 1 part aluminosilicate sol-gel and isopropanol mixture. The mixing time for step 1050 is not particularly important. However, longer mix times are preferred and one hour is a typical mix time.

Step 1060: Coat the desired substrate (i.e., phosphor particles 440 and outer surface 450 of lamp 400) with the reduced viscosity aluminosilicate sol-gel and isopropanol mixture by any conventional coating process. Preferred coating processes include spin and dip coating processes, with dip coating being preferred if the substrate is not a flat substrate. The substrate should be coated with the mixture to form a coating of the desired thickness.

Step 1070: Dry the aluminosilicate sol-gel and isopropanol mixture on the substrate at room temperature to evaporate at least a portion of the isopropanol solvent and to produce a substantially crack free organically modified aluminosilicate sol-gel film on the substrate. The drying time can vary, but is typically about one hour. It is believed that the elastomeric organic groups in the aluminosilicate sol-gel aid in preventing or minimizing cracking during the drying process.

Step 1080: Heat the organically modified aluminosilicate sol-gel film to enhance polymerization and to harden the film. Remaining organics are combusted and removed while the film is sintered. In preferred embodiments, the organically modified aluminosilicate sol-gel film is heated to about 400° C. by increasing the temperature by about 3° C. per minute. Once 400° C. is achieved, the temperature is maintained at 400° C. for at least one hour, but preferably about 5 hours to complete polymerization and to help to evaporate residual solvents.

It must be noted that the 400° C. temperature is not critical for preparing the aluminosilicate sol-gel film, but rather, is chosen so as to not damage the substrate (which in some preferred embodiments is contemplated to be a phosphor coated glass lamp). Higher temperatures are more preferable than lower temperatures. Therefore, in other embodiments, the temperature is chosen according to temperature limits of the substrate, but such that it is as high as 1000° C. The resulting sol-gel film in these other embodiments will have excellent properties and will remain substantially crack free. When heating the sol-gel film to only 400° C., some residual organic groups from the PDMS will typically remain in the film. If desired in other embodiments, it is contemplated that heating the sol-gel film to about 600° C. for a sufficient period of time will cause all of the organic groups to oxidize and bond off, resulting in a pure aluminosilicate oxide.

Step 1090: Cool the aluminosilicate sol-gel film to room temperature. The rate of cooling is not particularly important. In preferred embodiments, the source of heat is turned off and the sol-gel film is simply allowed to cool on its own. However, the rate of cooling can be increased or decreased considerably without causing substantial cracking in the sol-gel film. The result of this step is a hardened organically modified aluminosilicate sol-gel film or a hardened aluminosilicate oxide sol-gel film, depending on whether and to what extent the organic groups have been oxidized. In either case, the aluminosilicate film is substantially crack free.

While particular embodiments of the present invention have been shown and described, it should be clear that changes and modifications may be made to such embodiments without departing from the true scope and spirit of the invention. For example, although quartz is contemplated as the preferred lamp glass material, other UV transmissive materials can be used instead. Likewise, the gas mixture and the protective coating material and method of application can be changed. It is intended that the appended claims cover all such changes and modifications.

I claim:

1. A lumen depreciation resistant fluorescent lamp comprising:

a tube constructed of an ultraviolet (UV) radiation transmissive material;

a gas inside of the tube, the gas capable of producing UV radiation in response to an electrical stimulus; and a phosphor particle containing coating adhered to an outer surface of the tube, phosphor particles in the phosphor particle containing coating absorbing UV radiation produced by the gas inside of the tube and producing visible light in response.

2. The fluorescent lamp of claim 1 and further comprising a protective coating applied over the phosphor particle containing coating to protect the phosphor particles.

3. The fluorescent lamp of claim 1, wherein the phosphor particle containing coating also includes a phosphor protecting material.

4. The fluorescent lamp of claim 3, wherein the phosphor protecting material also serves to increase adhesion of the phosphor particles to the outer surface of the tube.

5. The fluorescent lamp of claim 4, wherein the phosphor protecting material is an aluminosilicate sol-gel material.

6. The fluorescent lamp of claim 1, wherein the UV radiation transmissive material is a quartz material.

7. The fluorescent lamp of claim 1, wherein the gas is an Ar/Hg mixture.

8. The fluorescent lamp of claim 6, wherein the UV transmissive material is resistant to damage caused by imbedding of Hg ions.

9. The fluorescent lamp of claim 1, wherein end portions of the tube are treated so as to be UV absorbing.

10. The fluorescent lamp of claim 1, wherein a UV reflective material is adhered to a coating outer surface on the phosphor particle containing coating to reflect UV radiation back toward the phosphor particle containing coating for use in producing visible light.

11. The fluorescent lamp of claim 10, wherein said outer surface of the tube is oriented generally in first directions while the coating outer surface is oriented generally in second directions opposite the first directions.

12. The fluorescent lamp of claim 10, wherein the tube is configured in a serpentine configuration and wherein the coating outer surface is positioned in a corner portion of the tube such that visible light output from the corner portion of the tube is increased as compared to other portions of the tube.

13. The fluorescent lamp of claim 11, wherein only selected areas of the coating outer surface are treated with a UV reflective coating.

* * * * *